US010161165B2

(12) United States Patent
Yuan

(10) Patent No.: US 10,161,165 B2
(45) Date of Patent: Dec. 25, 2018

(54) PORTABLE SUITCASE WITH ELECTRONIC COMBINATION LOCKING DEVICE

(71) Applicant: Dongguan ChongWei Metals & Plastic Products Factory Co., Ltd., Dongguan (CN)

(72) Inventor: Mengxiao Yuan, Dongguan (CN)

(73) Assignee: Dongguan Chongwei Metals & Plastic Products Factory Co., Ltd., Dongguan (CN)

( * ) Notice: Subject to any disclaimer, the term of this patent is extended or adjusted under 35 U.S.C. 154(b) by 0 days.

(21) Appl. No.: 15/703,590

(22) Filed: Sep. 13, 2017

(65) Prior Publication Data

US 2018/0080259 A1 Mar. 22, 2018

(30) Foreign Application Priority Data

Sep. 20, 2016 (CN) ..... 2016 1 0833986

(51) Int. Cl.

| | |
|---|---|
| ***E05B 65/52*** | (2006.01) |
| ***A45C 5/02*** | (2006.01) |
| ***A45C 5/03*** | (2006.01) |
| ***E05B 47/06*** | (2006.01) |
| ***E05B 49/00*** | (2006.01) |

(Continued)

(52) U.S. Cl.

CPC ..... *E05B 65/5284* (2013.01); *A45C 5/02* (2013.01); *A45C 5/03* (2013.01); *A45C 13/18* (2013.01); *E05B 47/0657* (2013.01); *E05B 49/00* (2013.01); *E05B 65/52* (2013.01); *A45C 2005/037* (2013.01); *E05B 47/0012* (2013.01); *E05B 2047/0017* (2013.01); *E05B 2047/0058* (2013.01); *E05C 9/047* (2013.01); *G07C 9/0069* (2013.01); *G07C 9/00944* (2013.01)

(58) Field of Classification Search

CPC ..... E05B 2047/0017; E05B 2047/0058; E05B 49/00; E05B 65/5284; E05B 65/52; E05B 47/0657; E05B 47/0012; E05B 65/5238; E05B 37/02; A45C 5/02; A45C 5/03; A45C 13/18; A45C 2005/037; E05C 9/047; G07C 9/0069; G07C 9/00944

USPC ..... 70/63, 69–72, 284, 285, 278.1

See application file for complete search history.

(56) References Cited

U.S. PATENT DOCUMENTS 3,555,860 A * 1/1971 Atkinson ..... E05B 37/02 292/42

4,838,052 A * 6/1989 Williams ..... E05B 19/0005 109/52

(Continued)

*Primary Examiner* — Suzanne L Barrett

(74) *Attorney, Agent, or Firm* — Wang Law Firm, Inc.

(57) ABSTRACT

A portable suitcase with an electronic combination locking device includes a suitcase body, a suitcase cover, a pair of lock hooks installed to the suitcase cover, a pair of first openings formed on the suitcase body for accommodating the lock hooks, a first locking device installed on an outer top surface of the suitcase cover, and a set of numeric keys and first buttons installed on the first locking device; a second locking device installed onto the suitcase body, a second button device installed onto the second locking device and disposed opposite to the first button, and a pair of latch mechanisms for receiving the actuation of the second button device, and the first locking device receives a correct unlock password to release the lock of the first button, and the second button device receives the actuation of the first button to detach the latch mechanism from the lock hook.

12 Claims, 5 Drawing Sheets

(51) Int. Cl.

| | |
|---|---|
| ***A45C 13/18*** | (2006.01) |
| *E05B 47/00* | (2006.01) |
| *E05C 9/04* | (2006.01) |
| *G07C 9/00* | (2006.01) |

(56) References Cited

U.S. PATENT DOCUMENTS 5,153,561 A * 10/1992 Johnson ..... A45C 13/24 190/101
5,161,396 A * 11/1992 Loeff ..... E05B 47/0002 109/59 T
5,507,161 A * 4/1996 Broekaert ..... E05B 47/00 292/201
5,701,770 A * 12/1997 Cook ..... E05B 47/02 206/1.5
5,881,584 A * 3/1999 Brunoski ..... E05B 17/2084 292/144
5,977,876 A * 11/1999 Coleman ..... A45C 13/10 340/539.1
6,318,134 B1 * 11/2001 Mossberg ..... E05B 63/248 292/144
6,845,640 B2 * 1/2005 Loeff ..... E05B 53/003 109/45
7,546,920 B1 * 6/2009 Horn ..... F41C 33/06 206/317
7,946,141 B2 * 5/2011 Ng ..... E05B 37/02 70/21
8,375,752 B2 * 2/2013 Chang ..... E05B 37/0031 70/162
9,222,284 B2 * 12/2015 Gokcebay ..... E05C 3/042
2005/0229655 A1 * 10/2005 Yu ..... A45C 13/00 70/63
2006/0162404 A1 * 7/2006 Hsieh ..... E05B 41/00 70/71
2009/0071208 A1 * 3/2009 Wang ..... E05B 47/0603 70/277
2013/0043751 A1 * 2/2013 Yuan ..... E05B 47/026 310/80
2018/0080254 A1 * 3/2018 Yuan ..... E05B 47/0012
2018/0082802 A1 * 3/2018 Yuan ..... H01H 13/14

* cited by examiner

PORTABLE SUITCASE WITH ELECTRONIC COMBINATION LOCKING DEVICE

FIELD OF INVENTION

The present invention relates to a suitcase, in particular to a portable suitcase with an electronic combination locking device.

BACKGROUND OF INVENTION

1. Description of the Related Art

Hard suitcases generally adopt a mechanical key to open a lock of the suitcase or adopt a combination lock. In the suitcases adopting the mechanical key to open the lock, the locking device, lock and key of the suitcases of this sort come with a simple structure, so that the lock can be opened by a similar key or tool. In the suitcases adapting the combination lock, the number of combinations is relatively small, and the unlock operation is relatively complicated. In addition, both of the aforementioned two types of locks are usually installed in a narrow space at the middle of a handle, and their operation is very inconvenient.

Some suitcases may adopt an electronic combination lock, such as a portable suitcase with an electronic combination locking device as disclosed in U.S. Pat. No. 4,495,540 filed by Presto Lock, Inc, and the portable suitcase comprises a panel installed on a side of a handle, and the panel comprises a display device and a plurality of numeric keys, and a mechanical switch operated in a horizontal direction is installed on the other side of the handle. After a correct unlock password is entered, the mechanical switch can be switched to open the suitcase lock. If a wrong password is entered or no password has been entered, then the mechanical switch cannot be switched. In German Pat. No. DE3242119A, a portable suitcase with an electronic combination control portable suitcase is disclosed, and the portable suitcase is similar to the aforementioned U.S. patent and comprises a keyboard installed on a side of a handle for inputting a password, a lock hook installed to a suitcase cover, and a latch mechanism installed to a suitcase body and configured to be corresponsive to the lock hook. After a correct unlock password is entered, an actuator assembly installed in the suitcase body actuates the latch mechanism, so that the lock hook can be unbuckled. In U.S. Pat. No. 4,426,862, an electronic locking device for suitcases is disclosed, and the electronic locking device comprises a panel installed on a surface of a suitcase body under a handle and further comprises an unlock button disposed on both sides separately. After a correct password is entered and confirmed, the buttons may be pushed outwardly to open the suitcase cover.

In the foregoing three technical solutions, the panel or keyboard for controlling the locking device is installed on a surface of the handle installed to the suitcase body. When the suitcase is opened, it is necessary to erect the portable suitcase to enter the password, and then the portable suitcase is placed horizontally before it can be opened. Unless the portable suitcase is placed horizontally on a higher tabletop, the password cannot be entered to open the suitcase cover. In addition, the surface of the suitcase body for installing the handle is small and narrow, and thus the layout and installation of the mechanical locking device and electronic control device will be difficult, which limits the widespread use of the portable suitcase with an electronic combination control.

2. Summary of the Invention

Therefore, it is a primary objective of the present invention to provide a portable suitcase comprising a panel device installed on the top surface of a suitcase cover, a mechanical locking device installed to a suitcase body without any electrical connection, and a mechanical button provided for actuating a mechanical locking device installed to the suitcase body.

To achieve the aforementioned and other objectives, the present invention provides a portable suitcase with an electronic combination locking device, comprising: a suitcase body, a suitcase cover hinged with the suitcase body, a pair of lock hooks symmetrically installed to the suitcase cover, a pair of first openings formed on the suitcase body and capable of accommodating the lock hook and a first locking device installed on the outer top surface of the suitcase cover, a plurality of numeric keys and first buttons installed onto the first locking device; a second locking device installed to the suitcase body, a second button device installed onto the second locking device and disposed opposite to the first button, wherein the latch mechanism receives the actuation of the second button device, and the first locking device receives a correct unlock password to release the lock of the first button, and the second button device receives the actuation of the first button to detach the latch mechanism from the hooking of the lock hook.

Wherein, the first locking device is a panel device comprising: an actuator assembly, a toggle member installed under the first button and actuated by the actuator assembly to rotate from a first position preventing the first button from moving downward to a second position allowing the first button to move downward; the second button device comprises: a lock seat with a second opening, a button seat installed in the second opening, a second button installed in the button seat and disposed opposite to the first button, and a pair of cams symmetrically installed in the button seat and actuated by the second button; the latch mechanism comprises: a pair of sliding plates symmetrically installed on both sides of the latch mechanism and actuated by the cams respectively to slide in the lock seat, a catch member installed onto the sliding plate for hooking the lock hook, and a second cylinder spring installed between the sliding plate and the catch member; and the first locking device comprises a actuating plate fixed to the first button, and the actuating plate is extended out from the bottom of the panel device and configured to be opposite to the second button.

wherein the panel device comprises a panel and a bottom plate, and the actuator assembly and toggle member are installed between the panel and the bottom plate, and the toggle member comprises: a bolt hub and a first arm extended from the bolt hub, a first tooth disposed on the bolt hub and a first groove formed adjacent to the first tooth, a pivot installed onto the bolt hub, a blind shaft hole formed on the panel and the bottom plate separately and matched with the pivot, and a first sliding groove formed on the first arm; the actuator assembly comprises: a motor, a drive shaft installed to a motor shaft, a first cylinder spring with a free end fixed and coupled to the drive shaft, a follower shaft capable of performing an axial displacement in the first cylinder spring, a pin installed onto the follower shaft and capable of rotating into the first cylinder spring and an end of the pin extending from the outer periphery of the first cylinder spring and installed into the first sliding groove; the first button comprises a first protrusion capable of entering into the first groove, and the toggle member is disposed at the first position, and first tooth and the first protrusion are aligned precisely with each other, and the toggle member is disposed at the second position, and the first groove and the first protrusion are aligned precisely with each other.

Wherein, the second button comprises: a horizontally installed pressure block, a pair of guide grooves formed on the pressure block, a pair of vertical plates perpendicular to the pressure block, and a horizontal plate coupled to the pair of vertical plates; the button seat comprises: a third opening for accommodating the pressure block, a pair of guide strips slidably configured and matched with the guide grooves, a pair of hinge cavities symmetrically formed on the outer side of the guide strip; and the cam comprises: a first flange disposed at the hinge cavity, a second flange abutting the lower edge of the pressure block, and a third flange abutting an end of the sliding plate.

Wherein, the panel comprises a first plane parallel to the top surface of the suitcase cover, and a second plane parallel to the vertical surface of the suitcase cover, and a fourth opening is formed at the interaction of the top surface and the vertical surface of the suitcase cover for installing the panel device, and a first protrusion is disposed in the fourth opening and has an inclination and an end facing downward, and a second protrusion is formed at a position corresponsive to the panel and matched with the elastic protrusion, and after the panel device is installed into the fourth opening, an end of the elastic protrusion abuts against the second protrusion.

The portable suitcase with an electronic combination locking device further comprises a boarder embedded into the fourth opening and fixed to the vertical surface in the fourth opening, and the elastic protrusion is the elastic plate installed downwardly from the end of the vertical surface in the border, and after the panel device is installed into the border, an end of the elastic plate abuts against the panel second protrusion.

The portable suitcase with an electronic combination locking device further comprises a lock installed onto the lock seat for detaching the latch mechanism and the lock hook by using a key to actuate the second button.

The portable suitcase with an electronic combination locking device further comprises a front cover installed to the suitcase body, a fixing post symmetrically installed to the front cover and capable of passing through a front wall of the suitcase body, a pair of mounting holes formed on the lock seat and matched with the fixing post, a lock hole formed on the front cover for exposing the front end surface of the lock, a pair of rectangular holes respectively and symmetrically installed to the both sides of the lock hole, and a pair of hasp members installed into and hinged with the rectangular hole.

The portable suitcase with an electronic combination locking device further comprises a power supply device installed in the suitcase cover and electrically coupled to the panel device, and the power supply device comprising a laminated battery and a holder fixed to the laminated battery, and the holder comprising a base fixed to an inner surface of the suitcase cover, a cover hinged with an end of the base, a hinge hole formed on the cover, a hinge shaft matched with the hinge hole, and a bias spring installed to the hinge shaft, and the inner surface of the cover being matched with a portion of the outer surface of the laminated battery, and a first free end of the bias spring being latched to the base, and a second free end abuts with a plane of the cover.

Wherein, the bias spring is a cylinder torsion spring, and the cylinder torsion spring comprises a spring coil, and the first free end of the spring coil is extended in perpendicular direction along the axis of the spring coil and bent into a half-rectangular frame to abut against the cover, and the second free end is extended out from the spring coil and bent into a lever parallel to the spring coil and abutting against the base, and the base comprises a third plane and a third vertical surface, and a circular tube formed and coiled at the upper end portion of the third vertical surface for accommodating the spring coil, and the third plane and the third vertical surface have a rib contacted with the outer surface of the laminated battery and a fixing hole formed on the suitcase cover for fixing the base, and the cover comprises: a pair of pawls installed on the inner surface of the front end of the cover and matched with the external periphery of the laminated battery, a pair of cylinders with a hinge hole installed at the rear end of the cover, a pair of second arms installed between the pawls and the cylinders, and a flat plate installed between the pair of second arms for pressing an outer plane of the laminated battery.

Preferably, the suitcase body and the suitcase cover are a wooden box with a metal frame and a wooden suitcase cover respectively.

Preferably, the suitcase body and the suitcase cover are respectively and integrally formed suitcase body and suitcase cover by plastic injection molding.

The present invention has the following advantages and effects:

1. The present invention adopts a structure that installs the panel device to the top surface of the suitcase cover, and installs the mechanical button on the panel for entering an unlock password to control the unlocking. The mechanical button is pressed to actuate the mechanical locking device installed onto the suitcase body, so that the locking device detaches the hooking of the lock hook of the suitcase cover. Such structure not just facilitates the users' unlock operation and password changing operation only, but also improves the safety and reliability of the portable suitcase locking device because the key quantity of the electronic combination lock is much greater than the key quantity of the mechanical combination lock, so as to improve the safety and reliability of the portable suitcase locking device.

2. The electronic control part and mechanical locking device are installed at the suitcase cover and the suitcase body respectively, and such arrangement not just overcomes the difficulty of laying and installing the electronic control part and mechanical locking device on the front vertical surface of the suitcase body. There is no electrical connection between the electronic control part and the mechanical locking device, and thus making the maintenance and repair more conveniently.

3. The lock installed under the second button can meet the requirement for opening the suitcase in a special situation.

4. The laminated battery holder has a simple and practical structure capable of fixing the laminated battery and replacing a battery quickly.

5. The present invention has the features of simple and compact structure, convenient operation, high safety, and wide scope of applicability.

DESCRIPTION OF THE PREFERRED EMBODIMENTS

The above and other objects, features and advantages of this disclosure will become apparent from the following detailed description taken with the accompanying drawings.

Figure 1:
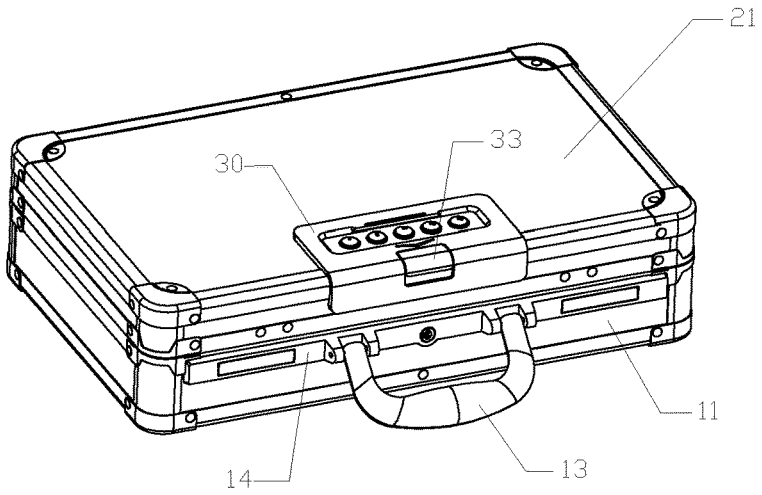
FIG. 1 is a perspective view of a preferred embodiment of the present invention, wherein a suitcase cover is situated at a closed status.
Figure 2:
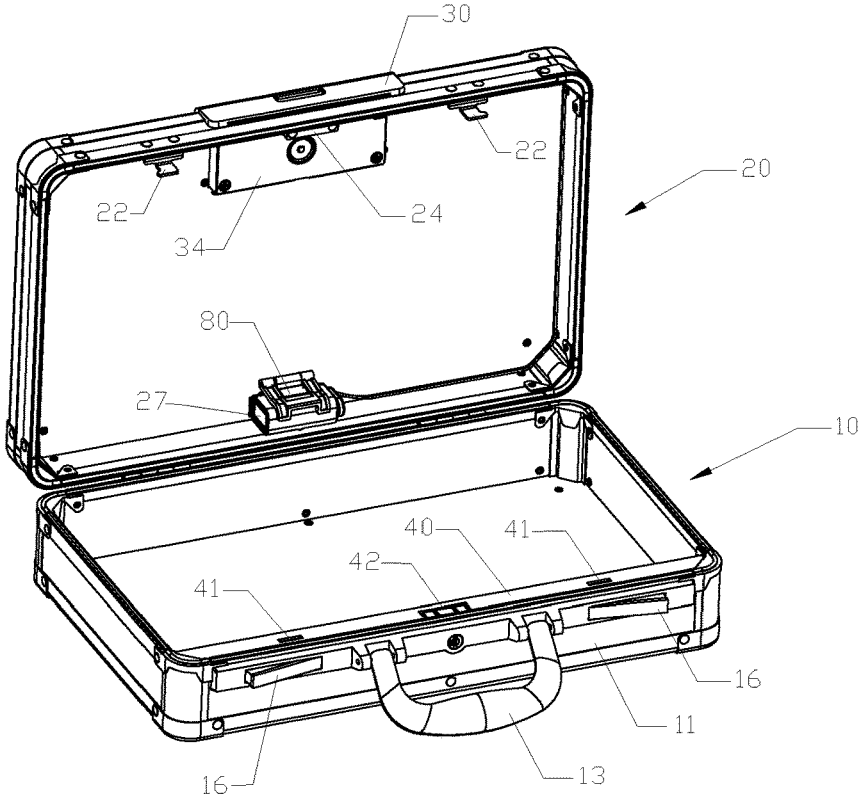
FIG. 2 is a perspective view of a preferred embodiment of the present invention, wherein a suitcase cover is situated at an open status.
Figure 4:
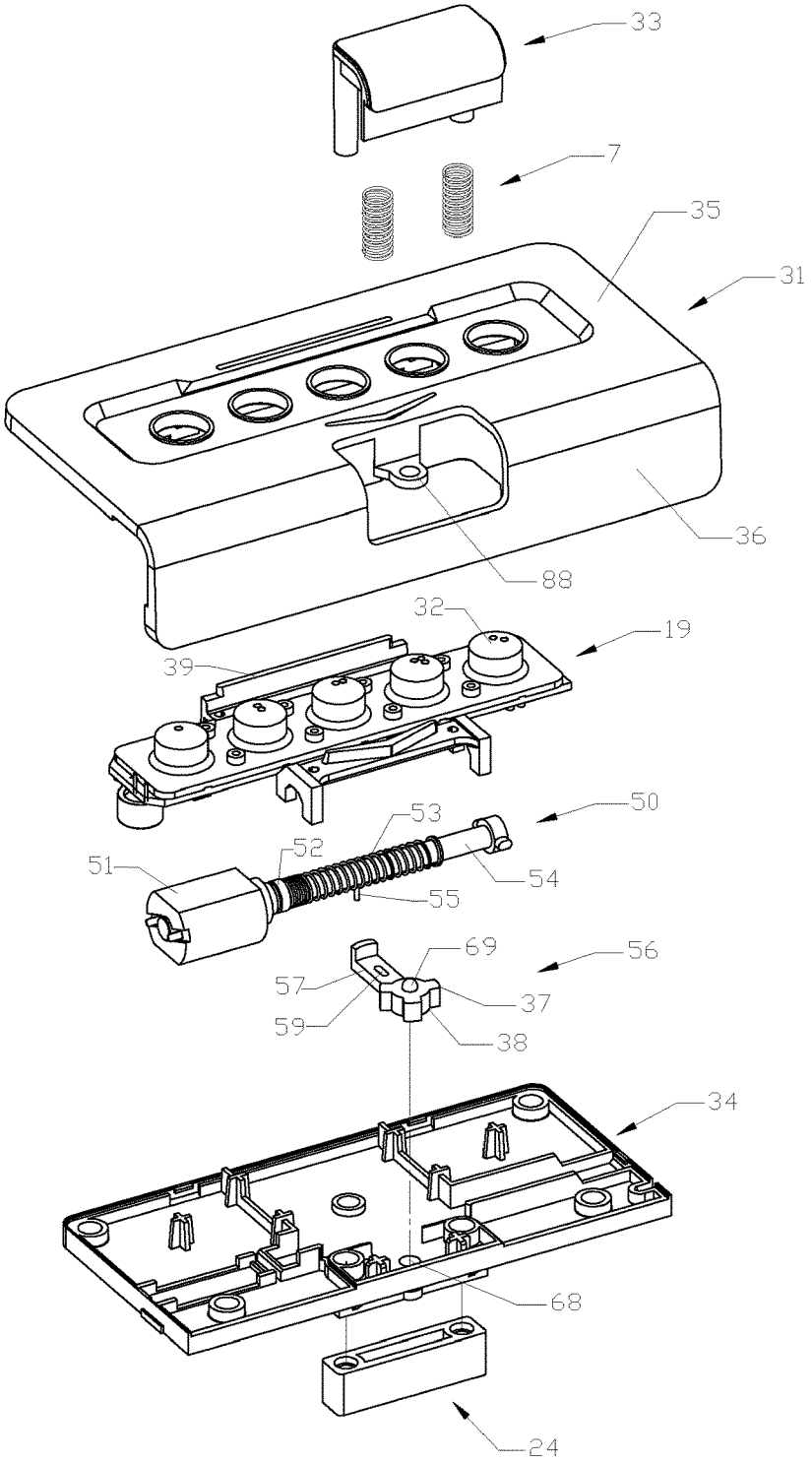
FIG. 4 is an exploded view of a panel device of a preferred embodiment of the present invention.

With reference to FIGS. 1, 2 and 4 for the structure of a portable suitcase in accordance with a preferred embodiment of the present invention, the portable suitcase is made of a hard material and may be a wooden box with a metal border, a plastic box made of a composite material and manufactured by plastic injection molding, or a metal box. Compared with the conventional portable suitcase, an obvious difference is that the first locking device is a panel device 30 installed onto a top surface 21 of the suitcase cover 20, and the first locking device comprises a group of numeric keys and first button 33. From a side view, the panel device 30 has two planes formed into an L-shape, the backside of its first plane 35 is attached tightly onto a top surface 21 of the suitcase cover 20, the backside of the second plane 36 is attached tightly onto a front vertical surface of the suitcase cover 20, five parallel numeric keys 32 are installed onto the first plane 35, the first button 33 is installed at the middle of the intersection line of the first plane 35 and the second plane 36, and the first button 33 is pressed vertically downwards.

Figure 3:
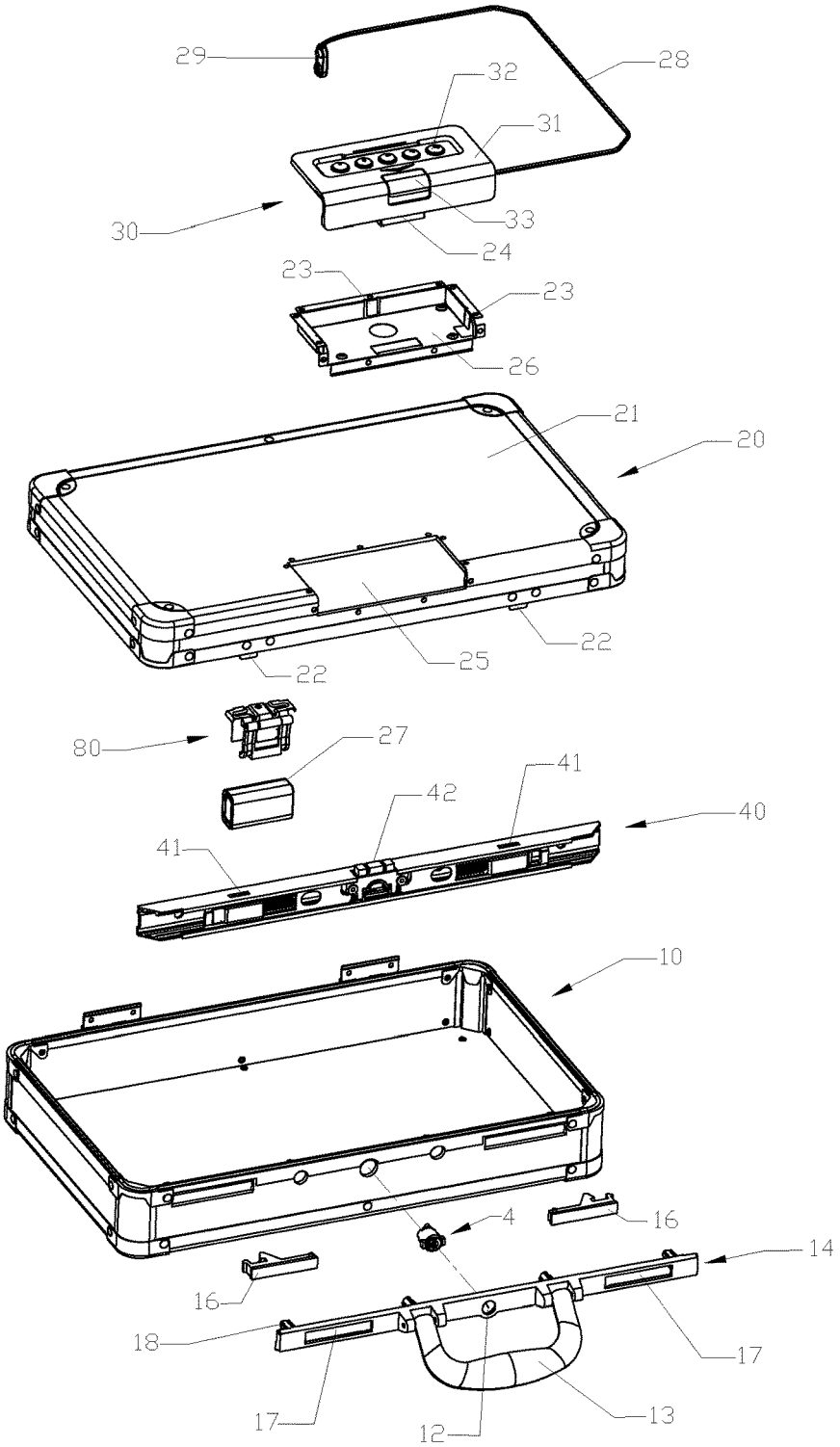
FIG. 3 is an exploded view of a preferred embodiment of the present invention.

In FIG. 3, the suitcase cover 20 installed at the position of the panel device 30 has a fourth opening 25, and a metal or plastic border 26 is embedded into the fourth opening 25, and the border 26 covers the inner surface of the fourth opening 25. To take the manufacturing process into consideration, the border 26 can ensure the size and surface flatness of the fourth opening 25. The border 26 has three elastic protrusions 23, and an opening or an end of the elastic protrusion 23 is configured to be facing downward, and the surface where the panel device 30 is in contact with the fourth opening 25 has a second protrusion (not shown in the figure) configured to be corresponsive to the three elastic protrusions, such that after the panel device 30 is installed into the fourth opening 25, the end of the three elastic protrusions abuts the protrusion to fix the panel device 30 securely. In this embodiment, the three elastic protrusions are three elastic plates with downward openings.

In FIGS. 1 to 5, the second locking device is a suitcase lock 40 including a lock seat 45 fixed to the inner side of the front vertical surface 11 of the suitcase body 10, a second button device installed at the middle of the lock seat 45 and including a button seat 47 and a second button 44, a pair of first cams 60 actuated by the second button 44, and a latch mechanism 3 installed on both sides of the second button device. The suitcase lock 40 further comprises a front cover 14 with a fixing post 18, and the fixing post 18 is passed through a front wall of the suitcase body 10 and fixed to a fixing hole of the lock seat 45. Unlike the structure of a conventional suitcase lock, the lock seat 45 has two first openings 41 exposed upwardly from the lock seat 45 and provided for entering or retreating the lock hooks 22, and also has a second opening 42 formed at the middle and exposed upwardly from the lock seat 45, and the button seat 47 is installed in the second opening 42, and the second button 44 is installed into the third opening 43 of the button seat 47, and its top surface is disposed exactly opposite to the actuating plate 24 fixed to the first button 33. Therefore, the suitcase lock 40 of this preferred embodiment is actuated by the first button 33 installed on the suitcase cover 20, which is completely different from the actuation of the conventional suitcase lock. Unlike the conventional portable suitcase, the front cover 14 of this invention is installed on an outer vertical surface 11 of the suitcase body 10, and the handle 13 is installed at the middle of the front cover 14, and a pair of hasp members 16 for restoring the position of the locked catch member 66 are installed on both sides of the handle 13 respectively.

With reference to FIG. 4 for the structure of the panel device 30 of the invention, the panel device 30 comprise a panel 31 and a bottom plate 34, and an actuator assembly 50 is installed between the panel 31 and the bottom plate 34 and capable of converting the rotation motion of the motor 51 into a linear motion, and the actuator assembly 50 comprises a drive shaft 52 installed at the axis of the motor, a first cylinder spring 53 fixed to the drive shaft, a follower shaft 54 installed in the inner periphery of the first cylinder spring 53 for performing an axial displacement, a pin 55 perpendicularly installed on the follower shaft and capable of rotating into the first cylinder spring 53, a dial lever 56 installed between the first button 33 and the bottom plate 34 and capable of rotating within a predetermined angle range, and the dial lever 56 comprises a bolt hub and a first arm 57 extended out from the bolt hub, and the bolt hub has a pivot 69 with both extending ends, and a support base of the panel 31 and the bottom plate 34 have a blind shaft hole 88 and a blind shaft hole 68 formed thereon and matched with both axial ends of the pivot 69 respectively, and dial lever 56 is rotatable round the two blind shaft holes. The first arm 57 has a first sliding groove 59 capable of receiving the head of the pin, and the external periphery of the bolt hub has three first teeth 37 and three first grooves 38 formed with an interval apart on the protrusion, and the first button 33 has three first protrusions (not shown in the figure) and capable of entering into the first groove 38. When the dial lever 56 is situated at the first position, the first tooth 37 abuts against the first protrusion to stop the first button 33 from displacing downwardly. When the dial lever 56 is situated at the second position, the first groove 38 is aligned precisely with the first protrusion, so that when the first button 33 is pressed, the first protrusion enters into the first groove 38, so as to control the first button 33. The first button 33 has an actuating plate 24 installed thereon and capable of extending out from the bottom plate 34, and an end surface of the actuating plate 24 of the first button 33 is in contact with the second button 44 in a face-to-face manner. In addition, a circuit board 19 is installed between the panel 31 and the bottom plate 34, and the numeric key 32 and a light signal indicator 39 are installed on the circuit board 19.

Figure 5:
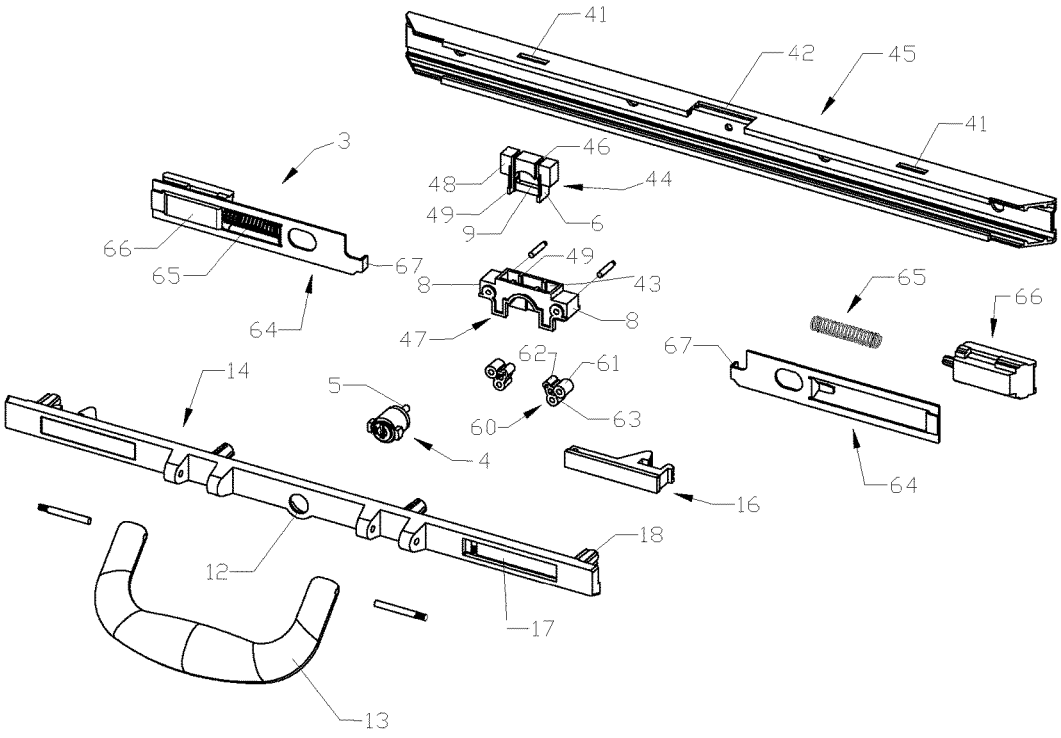
FIG. 5 is an exploded view of a suitcase lock of a preferred embodiment of the present invention.

With reference to FIG. 5 for the structure of the suitcase lock 40, the button seat 47 is installed in the second opening 42, and the second button 44 is installed into the third opening 43 at the top surface of the button seat 47, and the second button 44 includes a horizontally installed pressure block 48 and a downwardly extended pair of vertical plates 6, and the pressure block 48 has a vertical guide groove 46, and the button seat 47 includes a guide strip 49 slidably matched with the guide groove 46 and a hinge cavity 8 formed on both sides of the guide strip 49 separately. Both sides of the bottom of the button seat 47 are symmetrically disposed at the latch mechanism 3 inside the lock seat 45, and the latch mechanism 3 includes a pair of sliding plates 64 installed in the lock seat 45 and slidable in the lock seat, a pair of catch members 66 installed on the sliding plate 64, and a second cylinder spring 65 installed between the sliding plate 64 and the catch member 66. The first cam 60 includes a first flange 61 hinged with the hinge cavity 8 and a second flange 62 abutting against the bottom of the pressure block 48, and a third flange 63 abutting against an end 67 of the sliding plate 64. At the locked position, the second cylinder spring 65 is biased, and the bias force of the second cylinder spring 65 is transmitted through the sliding plate 64 and the first cam 60, so that the pressure block 48 props at the internal periphery of the third opening 43 of the button seat 47, so that a portion of the second button 44 is exposed from the second opening 42, and the catch member 66 is situated at the hooked position with respect to the lock hook 22. When the second button 44 is pressed by the first button 33, the second flange 62 disposed under the pressure block 48 is driven by a force to rotate the first cam 60, and the end 67 of the sliding plate 63 abutting against the third flange 63 is pushed by a force to slide outward, and the sliding plate 64 is pushed by the second cylinder spring 65 to detach the catch member 66 from the hooking of the lock hook 22.

In FIG. 5, the middle of the lock seat 45 (which is the rear side of the handle 13) has a lock 4. After a key is inserted, a lock cylinder can be rotated, and a bias shaft 5 is installed at the rear end of the lock cylinder and extended between the vertical plates 6 of the second button 44 and rested on the horizontal plate 9 of the second button 44, and the rotation of the bias shaft 5 can displace the second button 44 downward, so that the first cam 60 is rotated to push the sliding plate 64 to displace towards the outer side, and the catch member 66 is detached from the hooking of the lock hook 22. With the installation of the lock, a key of the lock can be used to open the suitcase in a special situation. The so-called special situation refers to the case of a user forgetting the unlock password, or the case of having a failure of the panel device 30, or a low level of battery 27 resulting in the situation of unable to operate the panel device 30, etc. The installation of the lock 4 further provides a choice. The lock may be replaced by a TSA luggage lock if needed.

In FIG. 5, a lock hole 12 is formed at the middle of the front cover and provided for exposing the key hole of the lock 4, and a pair of rectangular holes 17 are formed on both sides of the lock hole 12 respectively, and the hasp member 16 may be installed and hinged to the rectangular hole 17.

In FIGS. 2 and 3, the suitcase cover 20 has a laminated battery 27 installed in the hinged surface of the suitcase cover 20 for supplying power to the panel device 30, and a conductive wire is guided from an end of the panel device 30, and an end of the conductive wire 28 coupled to the battery has a battery snap 29 matched with the laminated battery 27 and jointed with the terminal of the battery, so as to complete the electrical connection with the panel device 30.

Figure 6:
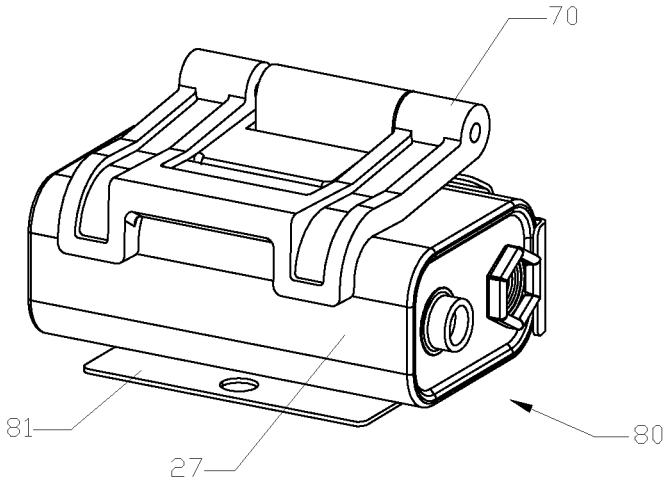
FIG. 6 is a perspective view of a battery holder of a preferred embodiment of the present invention.
Figure 7:
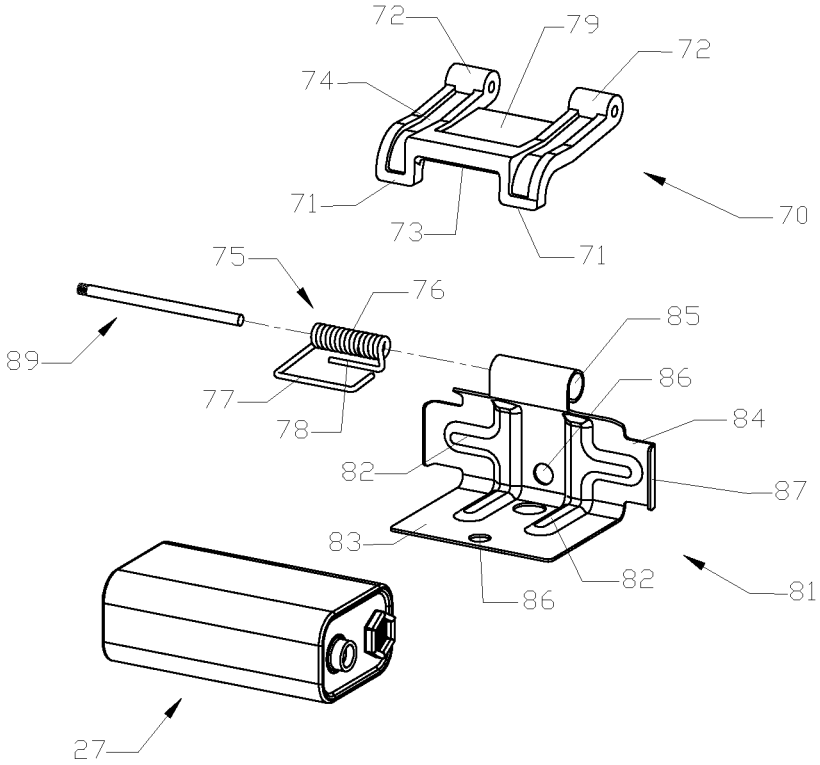
FIG. 7 is an exploded view of a battery holder of a preferred embodiment of the present invention.

With reference to FIGS. 6 and 7 for the structure of the battery holder 80 of the invention together with FIGS. 2 and 3, the laminated battery 27 is substantially in a rectangular shape, so that after the holder 80 is engaged, the laminated battery 27 is elastically and partially enclosed, and the holder 80 includes an L-shaped base 81 bent into 90 degrees, a plastic cover 70, and a cylinder torsion spring 75. The base 81 is formed by stamping a thin steel plate and includes a plane 83 and a vertical surface 84, and an end of the vertical surface 84 is coiled to form a circular tube 85 protruded out from the top of the vertical surface 84, and the spring coil 76 of the torsion spring 75 is installed into the circular tube 85. The base 81 has a through hole 86 formed on a surface of the base 81 for fixing the base 81 to the suitcase cover 20 to prevent the battery 27 from touching the screw head, and the plane 83 of the base 81 and the vertical surface 84 have smooth ribs 82 disposed thereon respectively, and both side ends of the base 81 have a pair of circular arc protrusions 87 latched to the bottom of the laminated battery 27 in the lengthwise direction. The cover 70 has a pair of pawls 71 symmetrically and downwardly protruded from the front end of the cover 70, and the inner surface of the pawl 71 matches the external periphery of the laminated battery 27, and the rear end of the cover 70 has a pair of cylinders 72, and the hinge hole is formed on the pair of the cylinder, and the second arm 74 is provided for connecting the pawl 71 and the cylinder 72, and a beam 73 is installed between the two arms 74, and the beam 73 is provided for opening the cover 70 to lease the hooked position manually, and a flat plate 79 is extended from the beam 73 towards the rear end. The cylinder torsion spring 75 includes a spring coil 76 with two free ends, wherein a first free end 77 is extended out from the external periphery of the spring coil 76 and bent into a non-closed half-rectangular frame, and a second free end is extended out from the spring coil and bent backward to form a lever parallel to the axis of the spring coil and abutting against the base. During assembling, the spring coil 76 is sheathed on the circular tube 85, and a hinge column 89 is passed into a hinge hole and the spring coil 76, and the first free end 77 is placed on the flat plate 79, and the second free end 78 abuts against the plane 83, and the torsion spring 75 is biased, so that the cover 70 and the base 81 are hinged by the torsion spring 75, and the cover 70 is rotated in a direction towards the base 81 by a bias force applied by the cylinder torsion spring 75, so that the laminated battery 27 is elastically and securely fixed to the inner surface of the suitcase cover 20.

In this preferred embodiment, the locking and unlocking processes are described as follows. If it is necessary to open the suitcase lock 40, a preset unlock password is entered through the numeric key 32 on the panel 31, and a program embedded in the panel device 30 determines whether or not the password is correct before driving the motor 51 to rotate, and the follower shaft 54 starts displacing linearly, while the pin 55 is pushing the dial lever 56 to rotate from the locked position to the unlocked position, so that the first tooth 37 for stopping the first button 33 to move downward is separated from its stopped position, and the signal indicator 39 installed on the circuit board 19 prompts a unlock indication of the first button 33, and the first button 33 is pressed, and the second button 44 is pushed by the first button 33 to move downward, so that the first cam 60 is pushed to rotate in a forward direction. The first cam 60 pushes the sliding plate 64 to displace towards the outside, and the second cylinder spring 65 is pushed by the sliding plate 64 to displace towards the outside, and the catch member 66 is pushed by the second cylinder spring 65 to displace towards the outside and detach the lock hook 22 from the hooked position. In the meantime, the catch member 66 pushes the hasp plate 16 to rotate out from the rectangular hole 17 of the front cover 14 for an angle, so as to complete the unlock process and manually open the suitcase cover 20. After the external force applied to the first button is released, the button resets the spring 7 to reset the first button 33. After the suitcase cover 20 is opened, the signal indicator 39 issues an indication signal, and the actuator assembly 60 resumes its sleep/standby state after the first button is locked.

If it is necessary to lock the suitcase, the suitcase cover 20 is covered, and then the hasp member 16 is pushed into the rectangular hole 17. After the catch member 66 is pressed by the pushing force of the hasp member 16, the catch member 66 is displaced towards the inner side, and after the second cylinder spring 65 is compressed to push the sliding plate 64 to displace towards the inner side, the first cam 60 is rotated by the reverse pushing force of the sliding plate 64, and the second button 44 is pushed upwardly for resetting. In the meantime, the catch member 66 returns to the hooked position of the lock hook 22, and the suitcase lock 40 enters into a locked state.

While the invention has been described by means of specific embodiments, numerous modifications and variations could be made thereto by those skilled in the art without departing from the scope and spirit of the invention set forth in the claims.

What is claimed is:

1. A portable suitcase with an electronic combination locking device, comprising:

a suitcase body, a suitcase cover hinged with the suitcase body, a pair of lock hooks symmetrically installed to the suitcase cover, a pair of first openings formed on the suitcase body for accommodating the lock hooks respectively, wherein the portable suitcase further comprises:

a first locking device installed onto the outer top surface of the suitcase cover, a set of numeric keys and a first button capable of being actuated installed onto the first locking device;

a second locking device installed onto the suitcase body, a second button device capable of being actuated installed onto the second locking device and disposed opposite to the first button, and a pair of latch mechanisms for receiving the actuation of the second button device, and the first locking device receives a correct unlock password to release the first locking device with the first button, and the second button device receives the actuation of the first button to detach the pair of latch mechanisms from the pair of lock hooks.

2. The portable suitcase with an electronic combination locking device according to claim 1, wherein the first locking device is a panel device comprising:

an actuator assembly, a toggle member installed under the first button and actuated by the actuator assembly to rotate from a first position preventing the first button to move downward to a second position allowing the first button to move downward;

the second button device comprises:

a lock seat with a second opening, a button seat installed in the second opening, a second button installed in the button seat and disposed opposite to the first button, and a pair of cams symmetrically installed in the button seat and actuated by the second button;

the latch mechanism comprises:

a pair of sliding plates symmetrically installed on both sides of the cams and actuated by the cams respectively to slide in the lock seat, a catch member installed onto the sliding plate for hooking the lock hook, and a second cylinder spring installed between the sliding plate and the catch member;

and the first locking device comprises an actuating plate fixed to the first button, and the actuating plate is extended out from the panel device and disposed opposite to the second button.

3. The portable suitcase with an electronic combination locking device according to claim 2, wherein the panel device comprises a panel and a bottom plate, and the actuator assembly and toggle member are installed between the panel and the bottom plate, and the toggle member comprises:

a bolt hub and a first arm extended from the bolt hub, a first tooth disposed on the bolt hub and a first groove formed adjacent to the first tooth, a pivot installed onto the bolt hub, a blind shaft hole formed on the panel and the bottom plate separately and matched with the pivot, and a first sliding groove formed on the first arm;

the actuator assembly comprises:

a motor, a drive shaft installed to a motor shaft, a first cylinder spring with a free end fixed and coupled to the drive shaft, a follower shaft capable of performing an axial displacement in the first cylinder spring, a pin installed onto the follower shaft and capable of rotating into the first cylinder spring and an end of the pin extending from the outer periphery of the first cylinder spring and installed into the first sliding groove;

the first button comprises a first protrusion capable of entering into the first groove, and the toggle member is disposed at the first position, and first tooth and the first protrusion are aligned precisely with each other, and the toggle member is disposed at the second position, and the first groove and the first protrusion are aligned precisely with each other.

4. The portable suitcase with an electronic combination locking device according to claim 2, wherein the second button comprises:

a horizontally installed pressure block, a pair of guide grooves formed on the pressure block, a pair of vertical plates perpendicular to the pressure block, and a horizontal plate coupled to the pair of vertical plates;

the button seat comprises:

a third opening for accommodating the pressure block, a pair of guide strips slidably configured and matched with the guide grooves, a pair of hinge cavities symmetrically formed on the outer side of the guide strip;

and the cam comprises:

a first flange disposed at the hinge cavity, a second flange abutting the lower edge of the pressure block, and a third flange abutting an end of the sliding plate.

5. The portable suitcase with an electronic combination locking device according to claim 2, wherein the panel comprises a first plane parallel to the top surface of the suitcase cover, and a second plane parallel to the vertical surface of the suitcase cover, and a fourth opening is formed at the interaction of the top surface and the vertical surface of the suitcase cover for installing the panel device, and an elastic protrusion is deposed in the fourth opening and has an inclination and an end facing downward, and a second protrusion is formed at a position corresponsive to the panel and matched with the elastic protrusion, and after the panel device is installed into the fourth opening, an end of the elastic protrusion abuts against the second protrusion.

6. The portable suitcase with an electronic combination locking device according to claim 5, further comprising a border embedded into the fourth opening and fixed to the vertical surface in the fourth opening, and the elastic protrusion is the elastic plate installed downwardly from the end of the vertical surface in the border, and after the panel device is installed into the border, an end of the elastic plate abuts against the second protrusion.

7. The portable suitcase with an electronic combination locking device according to claim 1, further comprising a lock installed onto the lock seat for detaching the latch mechanism and the lock hook by using a key to actuate the second button.

8. The portable suitcase with an electronic combination locking device according to claim 7, further comprising a front cover installed to the suitcase body, a fixing post symmetrically installed to the front cover and capable of passing through a front wall of the suitcase body, a pair of mounting holes formed on the lock seat and matched with the fixing post, a lock hole formed on the front cover for exposing the front end surface of the lock, a pair of rectangular holes respectively and symmetrically installed to the both sides of the lock hole, and a pair of hasp members installed into and hinged with the rectangular hole.

9. The portable suitcase with an electronic combination locking device according to claim 1, further comprising a power supply device installed in the suitcase cover and electrically coupled to the panel device, and the power supply device comprising a laminated battery and a holder fixed to the laminated battery, and the holder comprising a base fixed to an inner surface of the suitcase cover, a cover hinged with an end of the base, a hinge hole formed on the cover, a hinge shaft matched with the hinge hole, and a bias spring installed to the hinge shaft, and the inner surface of the cover being matched with a portion of the outer surface of the laminated battery, and a first free end of the bias spring being latched to the base, and a second free end abuts with a plane of the cover.

10. The portable suitcase with an electronic combination locking device according to claim 9, wherein the bias spring is a cylinder torsion spring, and the cylinder torsion spring comprises a spring coil, and the first free end of the spring coil is extended in perpendicular direction along the axis of the spring coil and bent into a half-rectangular frame to abut against the cover, and the second free end is extended out from the spring coil and bent into a lever parallel to the spring coil and abutting against the base, and the base comprises a third plane and a third vertical surface, and a circular tube formed and coiled at the upper end portion of the third vertical surface for accommodating the spring coil, and the third plane and the third vertical surface have a rib contacted with the outer surface of the laminated battery and a fixing hole formed on the suitcase cover for fixing the base, and the cover comprises:

a pair of pawls installed on the inner surface of the front end of the cover and matched with the external periphery of the laminated battery, a pair of cylinders with a hinge hole installed at the rear end of the cover, a pair of second arms installed between the pawls and the cylinders, and a flat plate installed between the pair of second arms for pressing an outer plane of the laminated battery.

11. The portable suitcase with an electronic combination locking device according to claim 1, wherein the suitcase body and the suitcase cover are a wooden box with a metal frame and a wooden suitcase cover respectively.

12. The portable suitcase with an electronic combination locking device according to claim 1, wherein the suitcase body and the suitcase cover are respectively and integrally formed suitcase body and suitcase cover by plastic injection molding.

* * * * *